US005401148A

United States Patent [19]

Foster et al.

[11] Patent Number: 5,401,148

[45] Date of Patent: Mar. 28, 1995

[54] MANUALLY OPERATED RECIPROCATING LIQUID PUMP

[75] Inventors: Donald D. Foster, St. Charles; Philip L. Nelson, Ellisville, both of Mo.

[73] Assignee: Contico International, Inc., St. Louis, Mo.

[21] Appl. No.: 228,024

[22] Filed: Apr. 15, 1994

[51] Int. Cl.[6] ..... F04B 53/12; B67D 5/42

[52] U.S. Cl. ..... 417/547; 222/384; 222/153

[58] Field of Search ..... 417/544, 547, 554; 222/153, 375, 383, 384, 385

[56] References Cited

U.S. PATENT DOCUMENTS

| | | | |
|---|---|---|---|
| 2,772,116 | 11/1956 | Dobkin | 417/547 |
| 3,257,961 | 6/1966 | Schlenker | 417/547 |
| 4,692,103 | 9/1987 | Anderson | 417/547 |

*Primary Examiner*—Richard A. Bertsch
*Assistant Examiner*—Peter Korytnyk
*Attorney, Agent, or Firm*—Rogers, Howell & Haferkamp

[57] ABSTRACT

A manually operated reciprocating liquid pump employs both a priming valve and a check valve where the priming valve performs the dual functions of priming the pump and sealing the pump to prevent inadvertent leakage of liquid through the pump when it is not in an upright orientation.

20 Claims, 1 Drawing Sheet

FIG. 3.
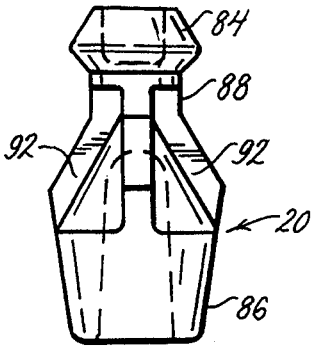
FIG. 1.
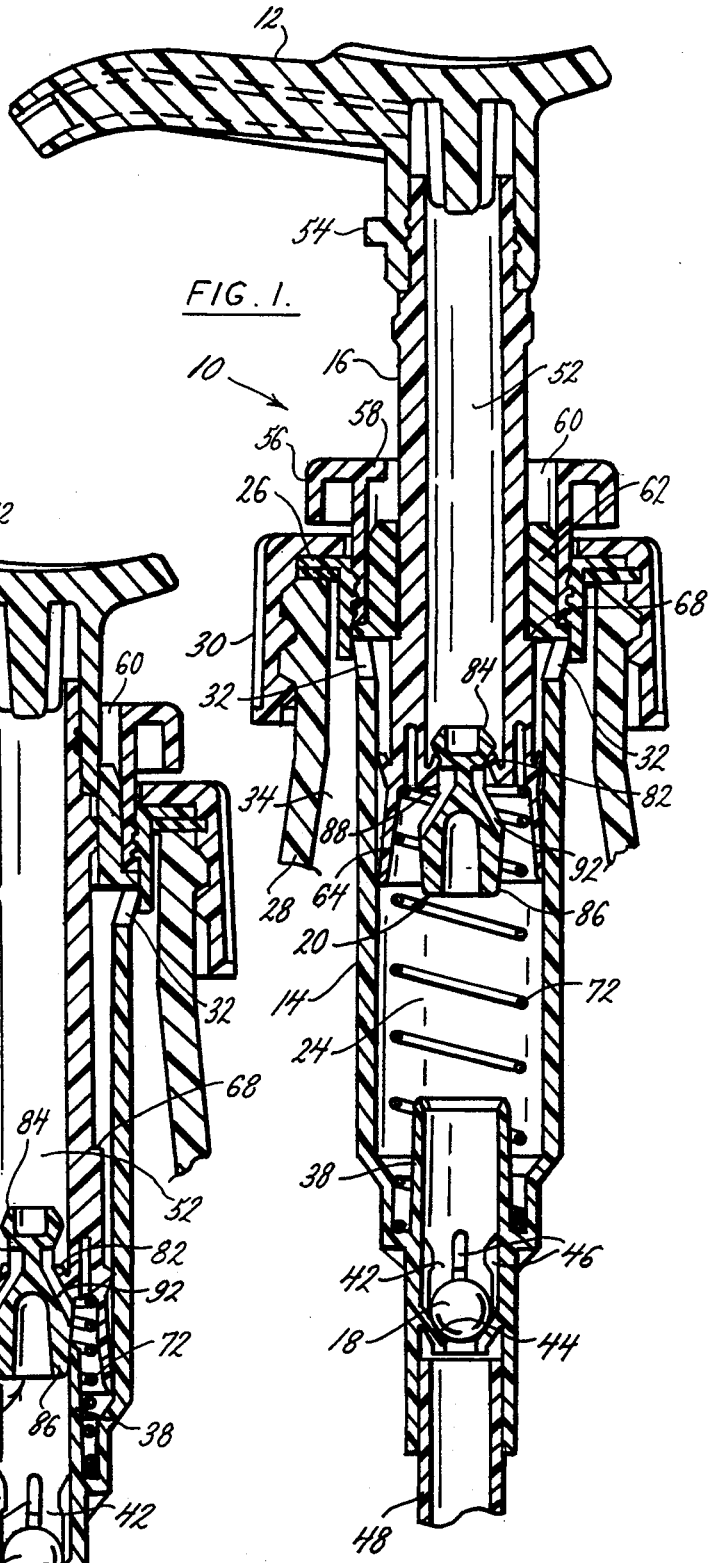
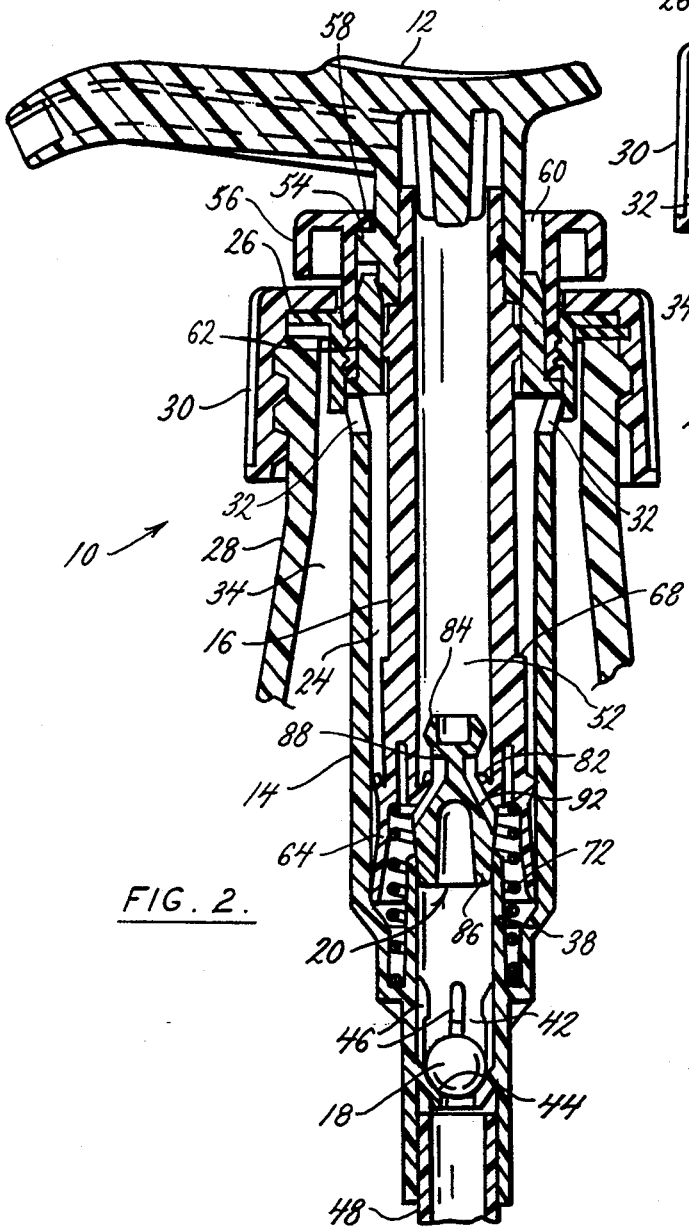
FIG. 2.

MANUALLY OPERATED RECIPROCATING LIQUID PUMP

BACKGROUND OF THE INVENTION (1) Field of the Invention

The inventive subject matter of the application pertains to a manually operated reciprocating liquid pump that employs both a priming valve and a check valve, where the priming valve performs the dual functions of priming the pump and sealing the pump to prevent inadvertent leakage of liquid through the pump when it is not in an upright orientation.

(2) Description of the Related Art

Manually operated reciprocating liquid pumps of the type employing a plunger with a dispensing head that is manually reciprocated downwardly into a pump housing connected to a liquid container and is then spring biased upwardly out of the pump housing to draw liquid out of the container and dispense the liquid often employ both a priming valve and a check valve. The priming valve unseats on the downward movement of the plunger into the pump housing to allow air in the empty pump housing to escape through the plunger and dispensing head, and then seats on the return stroke of the plunger upwardly out of the pump housing to draw liquid in the container up into the pump housing. The check valve seats on the downward movement of the plunger to prevent air or any liquid contained in the pump housing from being forced back into the container, and then unseats on the upward movement of the plunger to allow the vacuum created in the pump housing by the plunger's upward movement to draw liquid from the container past the check valve into the pump housing.

Very often ball valves are used for both the priming valve and check valve in manually reciprocated liquid pumps. However, the functioning of ball valves is dependent on gravitational forces which direct the ball of the valve downwardly to its seated position. Should a liquid container having a reciprocating pump with ball valves be moved from its upright orientation, for example being knocked over on its side or positioned in an inverted orientation while packaged during shipment, gravity no longer seats the ball valves and the liquid in the container can pass through and leak from the pump.

Reciprocating plunger pumps have been designed in a variety of constructions to prevent the pumps from leaking when the liquid container to which they are attached is positioned on its side or inverted. However, many of these designs require an elaborate construction of the reciprocating plunger pump to prevent its leaking and often require additional component parts to be added to the pump which increase its cost of production.

SUMMARY OF THE INVENTION

The present invention provides a manually operated reciprocating plunger pump in which existing component parts of a conventional plunger pump have been redesigned to seal the pump and prevent leakage of liquid through the pump when it is moved from its upright orientation. More specifically, the reciprocating plunger pump of the invention employs a ball valve as a check valve, but replaces the ball valve employed as a priming valve in many conventional plunger pumps with a novel valve element that serves both the function of a priming valve and a sealing plug that prevents leakage of liquid through the pump when the pump is turned on its side or inverted. The valve element of the invention replaces the ball priming valve found in many prior art reciprocating plunger pumps. Therefore the reciprocating pump of the invention does not have a more complicated construction or greater number of component parts than conventional reciprocating plunger pumps. The few number of component parts and the simplicity of their assembly provides a reciprocating plunger pump that is inexpensive to manufacture, is reliable in its operation, and prevents leakage through the pump when the container to which it is attached is turned on its side or inverted during use or shipment.

BRIEF DESCRIPTION OF THE DRAWING

Further objects and features of the present invention are revealed in the following detailed description of the preferred embodiment of the invention and in the drawing figures wherein:

FIG. 1 is a side elevation view, in section, of the reciprocating plunger liquid pump of the present invention with the plunger extended from the pump housing;

FIG. 2 is the same view of the reciprocating plunger pump of the invention as shown in FIG. 1 with the plunger in its depressed position in the pump housing; and FIG. 3 is an elevation view of the valve element of the invention showing the construction of the element in greater detail.

DESCRIPTION OF THE PREFERRED EMBODIMENT

The manually operated reciprocating liquid pump 10 of the present invention is shown in FIGS. 1 and 2 in an adaptation of the pump for dispensing a lotion. The lotion dispensing pump head 12 shown in the drawing figures is only one illustrative example of a use of the pump. It should be understood that the pump may be employed in dispensing a variety of different liquids and that the lotion dispensing head shown in the drawing figures should not be interpreted as limiting the use of the pump 10 to only lotions.

The reciprocating liquid pump 10 is basically comprised of a pump housing 14, a plunger 16, a ball check valve 18 and a valve element 20. All of these basic component parts of the invention may be constructed from plastic; however, in the best mode of the invention the ball check valve 18 is constructed of metal.

The pump housing 14 has a tubular, cylindrical configuration with a cylindrical interior bore 24 extending through the pump housing between top and bottom ends of the housing. A circular ring 26 is formed at the top of the pump housing and, as shown in FIGS. 1 and 2, the ring seats on the top edge of a liquid container 28 to support the pump housing in the container. An internally threaded cap 30 mounted on the pump housing for rotation about the housing center axis secures the pump housing on the top of the container 28. Just below the pump housing ring 26, a pair of vent openings 32 extend through the housing venting the container interior 34 through to the housing interior bore 24. Just below the vent openings 32 is a piston chamber area of the housing which receives the piston of the plunger 16 for reciprocating strokes of the piston as will be explained. The diameter of the pump housing is reduced at the housing bottom end and a cylindrical sealing sleeve 38 projects upwardly from the bottom of the housing into the interior bore 24. A check valve chamber 42 is provided Just below the sealing sleeve 38. The check valve chamber 42 is formed with an annular valve seat 44 and the ball check valve 18 rests on the seat. A plurality of shoulders 46 project into the pump housing interior bore just above the ball check valve 18 restricting the upward movement of the ball to the valve chamber. A dip tube 48 is secured to the bottom end of the pump housing 14 and extends downwardly to the bottom of the liquid container 28.

The plunger 16 also has a cylindrical, tubular configuration with a cylindrical interior bore 52 extending through the plunger between its top and bottom ends. The dispensing head 12 is secured to the top end of the plunger. As explained earlier, a different dispensing head other than the lotion dispensing head shown may be employed with the pump 10 of the invention. For example, the lotion dispensing head 12 may be replaced by a spray head specifically designed to dispense liquid from the head in a spray pattern. The spray head would likely be preferred when the pump of the invention is employed in dispensing a less viscous fluid from the container, and the lotion dispensing head 12 would likely be preferred when employing the pump to dispense a more viscous fluid from the container.

The dispensing head 12 shown has a locking tab 54, projecting from one side of the head. The locking tab 54 engages beneath an annular flange 58 of a locking ring 56 mounted to the container cap 30 for rotation relative thereto. The flange 58 of the ring has an opening 60 at one position on its circumference that allows the locking tab 54 to pass therethrough. By rotating the locking ring 56 on the container cap 30 so that the opening 60 is aligned with the locking tab 54, the dispensing head and plunger 16 are free to reciprocate through a stroke movement of the plunger relative to the pump housing. By depressing the plunger 16 downwardly through the locking ring 56 and container cap 30 so that the locking tab 54 passes through the locking ring opening 60, and then by rotating the locking ring 56 so that the opening 60 does not align with the locking tab 54, the plunger is locked in its relative position to the pump housing 24 shown in FIG. 2. A sealing ring 62 is also provided between the exterior of the plunger 16 and the interior of the locking ring 56 providing a seal between the interior bore 24 of the pump housing and the liquid container exterior.

A piston 64 is formed on the exterior of the plunger 16 at its bottom end. The piston 64 has a configuration that fits the piston in sliding, sealing engagement with the interior surface of the pump housing 14 at the piston chamber area. Reciprocating movement of the plunger 16 upwardly and downwardly relative to the pump housing 14 causes the piston 64 to reciprocate through a piston stroke between a top stroke position of the piston relative to the pump housing shown in FIG. 1 and a bottom stroke position of the piston relative to the pump housing shown in FIG. 2. The plunger 16 has an annular shoulder 68 formed on its exterior surface that engages against the underside of the seal 62 to limit the upward movement of the plunger in the pump housing interior bore 24. A coil spring 72 is positioned between the bottom of the plunger 16 and the bottom of the pump housing piston chamber. As seen in the drawing figures, the spring 72 extends around the sealing sleeve 38 of the pump housing and biases the plunger 16 upwardly to its top stroke position relative to the pump housing.

The valve element 20 is mounted in the plunger interior bore 52 for reciprocating movement with the plunger and also for relative reciprocating movement to the plunger. A flexible annular rim 82 is formed at the bottom of the plunger interior bore 52. The rim 82 gets its flexibility from the plastic material employed in constructing the plunger 16. The valve element 20 has a longitudinal length with a valve head 84 at the top of the element, a sealing plug 86 at the bottom of the element, and a neck or annular notch 88 formed intermediate the head and plug. The neck 88 of the valve element is formed with a plurality of flutes or axially extending grooves 92 between the head and plug sections of the element. The valve head 84 has a larger circumference than the circumference of the opening surrounded by the plunger annular rim 82 and causes the rim to resiliently expand as the valve head 84 is inserted through the rim from the bottom end of the plunger. The resiliency of the rim 82 allows it to contract around the neck 88 of the valve element and thereby mounts the valve element to the bottom end of the plunger inside the plunger interior bore 52. The rim 82 secures the valve element 20 to the plunger 16 for reciprocating movements with the plunger and the piston 64. The axial length of the valve element neck 88 allows the valve element to move axially relative to the plunger 16 for a limited range of movement. In FIG. 1 the valve element is shown moved to its extreme downward position relative to the plunger where the configuration of the annular rim 82 surrounds the valve head 84 and blocks fluid communication through the interior bore 92 of the plunger. FIG. 2 shows the valve element moved to its upward extreme position where the annular rim 82 extends around the flutes or axial grooves 92 of the valve element enabling fluid flow through the grooves and thereby communicating the pump housing interior bore 24 in fluid communication with the plunger interior bore 52. Furthermore, with the plunger fully depressed into the pump housing where the plunger piston 64 is moved to its bottom stroke position relative to the pump housing shown in FIG. 2, the valve sealing plug 86 seats within the top end of the pump housing sealing sleeve 38 sealing closed the fluid path extending from the dip tube 48 through the check valve chamber 42 and the pump housing interior bore 24 and plunger interior bore 52. In this position of the valve element 20, with the plunger locked down by the locking ring 56 and the valve element 20 seated in the sealing sleeve 38, the liquid in the container interior 34 will not leak through the pump 10 when the container is turned on its side or inverted.

The liquid pumping and dispensing operation of the reciprocating plunger pump 10 is similar to that of conventional reciprocating pumps employing two ball check valves. By manually depressing the dispensing head 12 downwardly causing the plunger 16 and piston 64 to move downwardly to the bottom stroke position of the piston shown in FIG. 2, the valve element 20 is moved to its upward position shown in FIG. 2 permitting fluid, whether air when initially priming the pump or the container liquid after the pump has been primed, to pass from the pump housing interior bore 24 through the valve element grooves 92 into the plunger interior bore 24 and out through the dispensing head 12. In releasing the manual force on the dispensing head allowing the coil spring 72 to push the plunger and piston upwardly to the top stroke position of the piston 64 shown in FIG. 1, the valve element 20 moves to its downward position shown in FIG. 1 sealing closed fluid communication through the plunger interior bore 52. The sealed plunger interior bore and the upward movement of the piston 64 increases the volume of the pump interior bore 24 creating a vacuum pressure within the pump interior bore that unseats the ball check valve 18 and draws additional liquid from the container interior 34 through the dip tube 48 up into the pump housing interior bore 24. By continued reciprocating movement of the plunger 16 relative to the pump housing, the liquid is continued to be drawn from the container interior and dispensed through the dispensing head.

The reciprocating plunger pump 10 of the present invention described above provides a simplified pump construction that is inexpensive to manufacture and easy to assemble and employs the valve element 20 to perform the dual tasks of a priming valve and a pump seal.

While the present invention has been described by reference to a specific embodiment, it should be understood that modifications and variations of the invention may be constructed without departing from the scope of the invention defined in the following claims.

What is claimed is:

1. A manually operated reciprocating liquid pump comprising:

a pump housing having a tubular configuration with an axial interior bore extending through the pump housing;

a plunger having a tubular configuration with an axial interior bore extending through the plunger, the plunger extending axially downwardly into the interior bore of the pump housing;

a piston on the plunger and received in the pump housing interior bore for axially reciprocating stroke movements of the piston therein between a bottom stroke position and an upwardly spaced top stroke position of the piston in the pump housing interior bore; and, a valve element mounted on the plunger inside the plunger interior bore for movement of the valve element with the plunger, the valve element is configured so that the valve element will seat with and seal closed the pump housing interior bore when the piston is in the bottom stroke position, and the valve element will unseat and separate from the pump housing interior bore when the piston stroke moves the piston upwardly from the bottom stroke position toward the top stroke position.

2. The pump of claim 1, wherein:

the valve element has an exterior surface that seats inside an interior surface of the pump housing interior bore to seal closed the pump housing interior bore when the piston is in the bottom stroke position.

3. The pump of claim 1, wherein:

the valve element has an axial length and a neck intermediate a valve head and a sealing plug projecting radially outwardly from the neck, and the plunger has a rim on its interior bore that projects inwardly from the plunger interior bore toward the valve element neck between the valve head and sealing plug of the valve element, the rim has a configuration that engages against and pushes downwardly on the sealing plug causing the sealing plug to seat with and seal closed the pump housing interior bore when the piston is moved downwardly to the bottom stroke position, and the rim has a configuration that engages against and pushes upwardly on the valve head causing the sealing plug to unseat and separate from the pump housing interior bore when the piston is moved upwardly from the bottom stroke position toward the top stroke position.

4. The pump of claim 3, wherein:

the valve head has an annular configuration and the plunger rim has an annular configuration complementary to the valve head configuration whereby the plunger interior bore is sealed closed when the rim engages against the valve head.

5. The pump of claim 1, wherein:

the valve element has an axial length and a valve head projecting outwardly from the valve element; and, the plunger has a rim projecting inwardly from its interior bore beneath the valve head, and the rim has a configuration that engages against and pushes upwardly on the valve head when the piston is moved upwardly from the bottom stroke position toward the top stroke position causing the valve element to unseat and separate from the pump housing interior bore.

6. The pump of claim 1, wherein:

the valve element has an axial length and a valve head projecting outwardly from the valve element; and, the plunger has an annular rim extending inwardly from its interior bore beneath the valve head, and the annular rim has a configuration complementary to the valve head whereby the valve head engages against the annular rim and thereby seals closed the plunger interior bore and is moved upwardly with the plunger when the piston stroke moves the piston from the bottom stroke position toward the top stroke position.

7. The pump of claim 1, wherein:

a spring is mounted in the pump housing interior bore beneath the plunger and engages between the pump housing and the plunger biasing the plunger upwardly in the pump housing interior bore, and the valve element is positioned inside the spring and does not contact with the spring.

8. The pump of claim 1, wherein:

a check valve is provided in the pump housing interior bore spaced axially from the valve element.

9. The pump of claim 8, wherein:

the check valve is positioned in the pump housing interior bore spaced axially below the plunger and valve element.

10. A manually operated reciprocating liquid pump comprising:

a pump housing having a tubular configuration with an axial interior bore extending through the pump housing;

a plunger having a tubular configuration with an axial interior bore extending through the plunger, the plunger extending axially downwardly into the pump housing interior bore;

a piston on the plunger and received in the pump housing interior bore for axially reciprocating stroke movements of the piston therein between a bottom stroke position and an upwardly spaced top stroke position of the piston in the pump housing interior bore;

a valve element mounted on the plunger inside the plunger interior bore for movement with the plunger, the valve element is configured so that the valve element will seat with and seal closed the pump housing interior bore when the piston is in the bottom stroke position, and the valve element will unseat from and open the pump housing interior bore when the piston stroke moves the piston upwardly from the bottom stroke position toward the top stroke position; and, a check valve positioned in the pump housing interior bore separated from the valve element.

11. The pump of claim 10, wherein:

the check valve is spaced axially below the valve element throughout the reciprocating stroke movements of the piston between the bottom stroke position and the top stroke position.

12. The pump of claim 11, wherein:

the valve element has an exterior surface that seats inside an interior surface of the pump housing interior bore to seal closed the pump housing interior bore when the piston is in the bottom stroke position.

13. The pump of claim 11, wherein:

the valve element has an axial length with a notch formed in the valve element intermediate its axial length; and, the plunger has a rim that extends into the plunger interior bore and into the valve element notch thereby mounting the valve element on the plunger, and the rim is configured to push the valve element downwardly when the piston stroke movement is toward the bottom stroke position and to push the valve element upwardly when the piston stroke movement is toward the top stroke position.

14. The pump of claim 13, wherein:

the valve element has a center axis and the valve element notch is an annular notch that extends around the center axis, the plunger rim extends into the annular notch and limits axial movement of the valve element relative to the plunger while enabling rotation of the valve element about its center axis relative to the plunger.

15. The pump of claim 10, wherein:

the valve element has an axial length with a neck formed in the valve element intermediate its axial length and a valve head and a sealing plug projecting outwardly from the neck, and the plunger has a rim that extends inwardly toward the valve element neck between the valve head and sealing plug thereby mounting the valve element on the plunger, the rim engages against and pushes downwardly on the valve element sealing plug causing the valve element to seat with and seal closed the pump housing interior bore when the piston is moved downwardly to the bottom stroke position, and the rim engages against and pushes upwardly on the valve element head causing the valve element to unseat from and open the pump housing interior bore when the piston is moved upwardly from the bottom stroke position.

16. The pump of claim 15, wherein:

the valve element head has an annular configuration and the projection rim has an annular configuration complementary to the head configuration whereby the plunger interior bore is sealed closed when the rim engages against the head.

17. The pump of claim 10, wherein:

the valve element has a configuration that causes the valve element to separate from the pump housing interior bore when the piston stroke moves the piston upwardly from the bottom stroke position.

18. A manually operated liquid pump comprising:

a pump housing having a tubular configuration with an axial interior bore extending through the pump housing;

a plunger having a tubular configuration with an axial interior bore extending through the plunger, the plunger extending axially downwardly into the pump housing interior bore;

a piston on the plunger and received in the pump housing interior bore for axially reciprocating stroke movements of the piston therein between a bottom stroke position and an upwardly spaced top stroke position of the piston in the pump housing interior bore;

a valve element mounted on the plunger inside the plunger interior bore for movement with the plunger, the valve element having an axial length with a notch formed in the valve element intermediate its axial length;

a rim on the plunger extending into the plunger interior bore and into the valve element notch thereby mounting the valve element on the plunger, the projection being configured to push the valve element downwardly when the piston stroke movement is toward the bottom stroke position and to push the valve element upwardly when the piston stroke movement is toward the top stroke position; and, a check valve positioned in the pump housing interior bore separately from and spaced entirely axially below the valve element.

19. The pump of claim 18, the valve element has an exterior surface that seats inside an interior surface of the pump housing interior bore to seal closed the pump housing interior bore when the piston is in the bottom stroke position.

20. The pump of claim 18, wherein:

the valve element has a center axis and the valve element notch is an annular notch that extends around the center axis, the plunger rim extends into the annular notch and limits axial movement of the valve element relative to the plunger while enabling rotation of the valve element about its center axis relative to the plunger.

* * * * *